United States Patent [19]

Cartwright et al.

[11] 4,059,505

[45] Nov. 22, 1977

[54] SEPARATING HYDROCARBONS

[75] Inventors: Colin William Cartwright, Woking; Donald Lamb, Farnborough, both of England

[73] Assignee: The British Petroleum Company Limited, Sunbury-on-Thames, England

[21] Appl. No.: 668,843

[22] Filed: Mar. 22, 1976

[30] Foreign Application Priority Data

Apr. 8, 1975 United Kingdom ..... 14313/75

[51] Int. Cl.[2] ..... C07C 7/13; C10G 25/04

[52] U.S. Cl. ..... 208/310 Z; 260/676 MS

[58] Field of Search ..... 208/310 Z; 260/676 MS

[56] References Cited

U.S. PATENT DOCUMENTS

| | | | |
|---|---|---|---|
| 2,901,519 | 8/1959 | Patterson et al. | 208/310 Z |
| 2,912,473 | 11/1959 | Hutchings | 208/310 Z |
| 3,244,619 | 4/1966 | Franz et al. | 208/310 Z |
| 3,373,103 | 3/1968 | Cooper et al. | 208/310 Z |
| 3,422,003 | 1/1969 | Anstey et al. | 208/310 Z |
| 3,428,552 | 2/1969 | Turnbull et al. | 208/310 Z |

*Primary Examiner*—Herbert Levine

*Attorney, Agent, or Firm*—Morgan, Finnegan, Pine, Foley & Lee

[57] ABSTRACT

Molecular sieve pressure swing separating process is modified by stopping the feed before the end of the adsorption stage and passing a mixture richer in n-paraffins than the feed through the sieve bed. Suitable mixtures include purge effluent and desorpting effluent. This enhances the purity of the product.

8 Claims, No Drawings

SEPARATING HYDROCARBONS

This invention relates to a cyclic process for the separation of n-paraffins from mixtures thereof together with non-straight chain hydrocarbons, e.g. cycloparaffins, isoparaffins and aromatics, using a bed of 5A molecular sieve.

In such a process only the n-paraffins are able to enter the pores of the sieve and when a feed containing n-paraffins in admixture with non-straight chain hydrocarbons, e.g. branched chain or cycloparaffins, is passed through the bed of the sieve, the branched chain and cycloparaffins come out in the effluent and the n-paraffins are adsorbed. The n-paraffins are subsequently removed in a separate stage called a desorption stage.

The separation of n-paraffins from non-straight chain hydrocarbons using a 5A molecular sieve has been previously described, e.g. in U.K. Pat. Nos. 1,026,116 and 1,110,494 in which desorption is effected by pressure reduction.

Thus, two products are obtained from a molecular sieve separation process, namely, the n-paraffins which are the effluent from the desorption stage and the non-straight chain hydrocarbons (denormal product) which are the effluent from the adsorption stage. When the feed is a kerosine or gas oil the desired product is usually the n-paraffins but when the feed is a gasoline the desired product is usually the relatively high octane non-straight chain hydrocarbons. Each process is usually operated to maximise the yield of the desired product.

One important use for the n-paraffin product is in the production of protein by the cultivation of micro-organisms. For this use the n-paraffin product is required to be of very high purity, typically at least 98% wt or even higher.

An improvement has now been invented which permits the purity of n-paraffins to be increased.

According to the present invention a cyclic vapour phase process for separating n-paraffins boiling in the gasoline, kerosine or gas oil ranges from a feed mixture thereof with non-straight chain hydrocarbons, by means of a bed of a 5A molecular sieve, comprises:

i. an adsorption stage in which the feed mixture is passed into the bed and an effluent produced from which the n-paraffins have been at least partly removed, and ii. a desorption stage in which the n-paraffins are desorbed from the bed by pressure reduction, wherein the feed is stopped to the adsorption stage when at least 50% of the breakthrough volume (as hereinafter defined) has been passed and a mixture richer in n-paraffins than the feed is passed through the bed.

The front which moves through the bed in the adsorption stage is not sharp and the content of n-paraffins in the effluent increases from typically 0.2% to the same value as the feed over a period of several seconds. The breakthrough point is considered to be the mid point of the period in which the composition of the effluent increases from the level prevailing during the greater part of the adsorption stage, i.e., about 0.2%, to that of the feed. The breakthrough volume is the volume of feed passed into the bed from the start of the adsorption stage to the breakthrough point.

The desorption can be effected by pressure reduction as described in U.K. Pat. Nos. 1,026,116 and 1,110,494.

Preferably a purge stage is interposed between the adsorption and desorption stages to remove surface adsorbed and interstitial material. The purge stage can be effected by pressure reduction, for example, as disclosed in the above mentioned UK Patents.

The feed can be fresh material, e.g., direct from a hydrofiner or distillation unit, or can be an admixture of fresh material with streams from other parts of the process, e.g., purge effluent or partly denormalised material obtained as an effluent in the adsorption stage after breakthrough.

The mixture richer in n-paraffins than the feed is preferably effluent obtained from the purge stage or n-paraffin product obtained as effluent from the desorption stage.

Preferably 50–150% of the breakthrough volume of feed is passed through the bed, more preferably 90–110%, in the adsorption stage before introduction of the mixture richer in n-paraffins than the feed.

Preferably the feed and the n-paraffin richer mixture are passed at constant rates in the gas phase so the volumes passed into the bed are proportional to the durations for which they are passed.

The molecular sieve is conventionally held in a vessel called an adsorber.

The purpose of passing the n-paraffin richer mixture is to increase the n-paraffin content of the void spaces in the adsorber and the macroporous structure of the sieve.

Regardless of whether the feed mixture is a gasoline, kerosine, or gas oil range material, it is preferred to pass the n-paraffin richer mixture, e.g. n-paraffin product, into the bed until 20–100% of the adsorber volume has been passed into the bed, more preferably 40–80%.

When the n-paraffin richer mixture is effluent from a purge stage it is preferred to pass the entire effluent collected from the purge stage as the n-paraffin richer mixture rather than to blend part with the feed mixture.

Preferably the mixture richer in n-paraffins than the feed contains at least 10% by wt. more n-paraffins than the feed, more preferably at least 20% more. Typically a purge effluent contains from 30–80% by wt. of n-paraffins. n-Paraffin product typically contains at least 95% wt. n-paraffins, often as least 98% wt. n-paraffins.

Since the process is performed in a cyclic manner, the adsorption stage of one cycle follows immediately after the desorption stage of a preceding cycle. Because desorption is effected by pressure reduction, the pressure in the bed at the start of the adsorption stage is therefore very low and a first part of the adsorption stage is preferably carried out as a pressurising up step by passing the feed into the bed but keeping the outlet valve(s) closed.

Preferred operating temperatures for different range feedstocks are 325°–375° C for gasoline, 350°–400° C for kerosine, and 380°–420° C for gas oil.

Preferred adsorption pressures also vary with the feedstock, being 5–500 psia for gasoline and 5–50 psia for kerosine and gas oil.

The preferred intermediate purge pressure also depends upon the actual boiling range of the feedstock. For example, when treating a gasoline fraction of average carbon number about $C_7$ boiling in the range $C_4$ —180° C, a purge pressure range of 2–50 psia is preferred, while 5–150 torr is preferred for kerosine range fractions of average carbon number about $C_{11}$ boiling between 150°–250° C, and for gas oil fractions.

Similarly, the preferred desorption pressure varies according to the feedstock boiling range, being in the range 10–300 torr for gasoline and 0.1–20 torr for kerosine and gas oil fractions.

For kerosine and gas oil feedstocks, the pressure reduction in the third stage, desorption, is preferably achieved by direct condensation with recycled n-paraffin product. For a gasoline feedstock the pressure reduction in the third stage is preferably achieved by means of an ejector, for example as described in our copending British application No. 35614/73.

It is to be understood that during the adsorption stage, pressure is increasing and the quoted figures relate to the maximum pressure achieved at the end of the stage. The initial pressure may well be outside the quoted range.

Conversely, during purging and desorption, pressure is decreasing and the quoted figures relate to the minimum pressure achieved at the end of each stage. Again, the initial pressures may well be outside the ranges.

The durations of the three stages may be such that the desorption plus purge duration is a simple multiple of the adsorption duration. Alternatively, and preferably, however, the durations of the adsorption and desorption are whole-number multiples of the purge. The purge duration should not exceed three minutes, one or two minutes being preferred. The adsorption and desorption periods may be, respectively, 1–5, preferably 1–2 minutes, and 2–10, preferably 3–8 minutes.

The process is preferably operated using a number of fixed beds of sieve so that at any given time, one or more beds are adsorbing, purging and desorbing. The ratio of the number of beds respectively, adsorbing, purging and desorbing at any given moment is preferably the same as the ratio of the durations of the adsorption, purge and desorption stage. This ratio may be 1:1:*n* where *n* is an integer between 1 and 6, 1:1:3 being preferred. Thus, for example, with a ratio of 1:1:3, a total of 5 sieve beds is required. A further additional bed may also be provided to permit periodic regeneration, e.g., by burning off, to remove carbonaceous deposits without interrupting the adsorption-purge-desorption cycle.

The feed rate to the adsorption stage is preferably 0.5–2.5 v/v/hour, particularly 1.0–2.0 v/v/hour.

When the n-paraffin richer mixture is purge effluent, the proportions of the adsorption stage devoted to feed mixture and purge effluent will preferably be proportional to the amount of feed mixture and purge effluent.

When the n-paraffin richer mixture is n-paraffin product, preferably 5–15 seconds of the adsorption stage is devoted to passing the n-paraffin product into the bed.

The invention is illustrated by the following examples.

EXPERIMENT A

This experiment is not according to the invention and is included for comparative purposes only.

The fresh feed was a hydrofined gas oil boiling in the range 240°–330° C, containing 20 percent weight of n-paraffin and a sulphur content of 120 ppm.

Fresh feed mixed with recycled purge in adsorption stage.

425 ml of fresh feed (20 percent weight n-paraffins) were mixed with 125 ml of purge (45 percent weight n-paraffins) from the previous cycle. This 550 ml of feed, containing 25.7 percent weight of n-paraffins and representing 105 percent of the breakthrough volume, was processed cyclically under the conditions given in Table 1.

Table 1

| Stage | Duration | Temperature | Pressure at end of Stage |
|---|---|---|---|
| Adsorption | 90 s | 400° C | 1350 torr |
| Purge | 90 s | 400° C | 20 torr |
| Desorption | 270 s | 400° C | 2 torr |

The sieve was a 5A molecular sieve, consisting of 4–8 mesh beads. The adsorber was 5 feet long and 4 inches in diameter and contained 8.3 kg of sieve.

For the first 9 seconds of the adsorption stage the bed was pressured up from 2 torr to 1350 torr. At this pressure the outlet valve from the adsorber was opened and effluent was collected for the next 81 seconds. The feed was then stopped and the adsorber was then purged and desorbed by the method described in U.K. Pat. No. 1,110,494.

The purge effluent was the same as the previous cycle. 125 ml of 45 percent weight n-paraffins were obtained.

The desorption effluent contained 98 percent weight n-paraffins and was obtained at a rate of 0.80 percent sieve weight/cycle.

EXAMPLE 1

Fresh feed followed by recycled purge effluent in the adsorption stage.

This experiment was carried out exactly as in Experiment A except that the 425 ml of fresh feed (containing 20 percent weight n-paraffins) were passed to the adsorber during the first 70 seconds of the adsorption stage — at the end of 70 seconds the fresh feed flow was stopped and for the last 20 seconds of the adsorption stage the 125 ml of purge (containing 45 percent weight n-paraffins) from the previous cycle was fed to the adsorber.

The desorption effluent contained 98.5 percent weight n-paraffins and was obtained at a rate of 0.8 percent sieve weight/cycle.

Comparison with Experiment A shows that by passing purge effluent at the end of the adsorption stage, instead of mixing it with the fresh feed, the purity of the n-paraffin product can be increased from 98.0 to 98.5 percent weight.

EXAMPLE 2 n-Paraffin product passed at the end of the adsorption stage.

This example was carried out exactly as in Experiment A except the adsorption stage was extended to 99 seconds, the 550 ml of feed (mixed fresh feed and recycle purge) were passed into the adsorber during the first 90 seconds and for the next 9 seconds 55 mls of n-paraffin product (6.2 liters of gas) (containing 99 percent n-paraffins) was passed The desorption effluent contained 99.0 percent weight n-paraffins and was obtained at a rate of 0.8 percent sieve weight/cycle.

Comparison with Experiment A shows that by passing n-paraffin product at the end of the adsorption stage, the n-paraffin product can be increased from 98.0 to 99.0 percent weight.

We claim:

1. A cyclic vapour phase process for separating n-paraffins boiling in the gasoline, kerosine or gas oil ranges from a feed mixture thereof with non-straight chain hydrocarbons by means of a bed of a 5A molecular sieve comprising:

i. an adsorption stage in which the feed mixture is passed into the bed under conditions of increasing pressure and an effluent produced from which the n-paraffins have been at least partly removed, and ii. a desorption stage in which the n-paraffins are desorbed from the bed by pressure reduction wherein the feed is stopped to the adsorption stage when at least 50% of the breakthrough volume has been passed and then a mixture richer in n-paraffins than the feed is passed through the bed, while the pressure is still rising.

2. A process according to claim 1 wherein a purge stage effected by pressure reduction is interposed between the adsorption and desorption stages.

3. A process according to claim 1 wherein the mixture richer in n-paraffins than the feedstock is n-paraffin product obtained as effluent from the desorption stage.

4. A process according to claim 2 wherein the mixture richer in n-paraffins than the feedstock is effluent obtained from the purge stage.

5. A process according to claim 1 wherein 50–150% of the breakthrough volume of feed is passed through the bed in the adsorption stage before introduction of the mixture richer in n-paraffins than the feed.

6. A process according to claim 5 wherein 90–110% of the breakthrough volume of feed is passed through the bed in the adsorption stage before introduction of the mixture richer in n-paraffins than the feed.

7. A process according to claim 1 wherein the mixture richer in n-paraffins than the feed is passed into the bed until 20–100% of the adsorber volume has been passed into the bed.

8. A process according to claim 7 wherein the mixture is passed until 40–80% of the adsorber volume has been passed.

* * * * *